United States Patent [19]

Rosenthal et al.

[11] 3,988,122

[45] Oct. 26, 1976

[54] MOTOR FUEL COMPOSITION

[75] Inventors: Joel W. Rosenthal, El Cerrito; Robert H. Kozlowski, Berkeley, both of Calif.

[73] Assignee: Chevron Research Company, San Francisco, Calif.

[22] Filed: June 30, 1975

[21] Appl. No.: 591,344

Related U.S. Application Data

[63] Continuation-in-part of Ser. No. 163,517, June 25, 1971, abandoned.

[52] U.S. Cl. ..... 44/56

[51] Int. Cl.[2] ..... C10L 1/02

[58] Field of Search ..... 44/56; 208/16, 17

[56] References Cited

UNITED STATES PATENTS

| | | | |
|---|---|---|---|
| 1,516,907 | 11/1924 | Backhaus | 44/56 |
| 1,757,837 | 5/1930 | Johns | 44/56 |
| 1,757,838 | 5/1930 | Johns | 44/56 |
| 1,907,309 | 5/1933 | Schaak, Jr. | 44/56 |
| 2,087,582 | 7/1937 | Schnieder | 44/56 |
| 2,852,356 | 9/1958 | Lichtenfel | 208/17 |
| 2,897,067 | 7/1959 | Sparks et al. | 44/56 |
| 3,455,664 | 7/1969 | Rosscup et al. | 44/56 |
| 3,576,891 | 4/1971 | Rosenthal | 44/56 |

*Primary Examiner*—Allen B. Curtis
*Assistant Examiner*—Mrs. Y. Harris-Smith
*Attorney, Agent, or Firm*—G. F. Magdeburger; R. H. Davies; J. J. De Young

[57] ABSTRACT

A motor fuel comprising 85–99 volume percent gasoline-boiling-range hydrocarbons and 1 to 15 volume percent oxylate.

The oxylate consists of tertiary butyl alcohol, isopropyl alcohol, and methyl alcohol. Preferred composition for the oxylate is about 20–90 volume percent tertiary butyl alcohol, 5–40 volume percent isopropyl alcohol, and 5–40 volume percent methyl alcohol.

The oxylate improves the octane of the gasoline-boiling-range hydrocarbons more than expected, and the motor fuel containing oxylate is an excellent unleaded gasoline.

4 Claims, 1 Drawing Figure

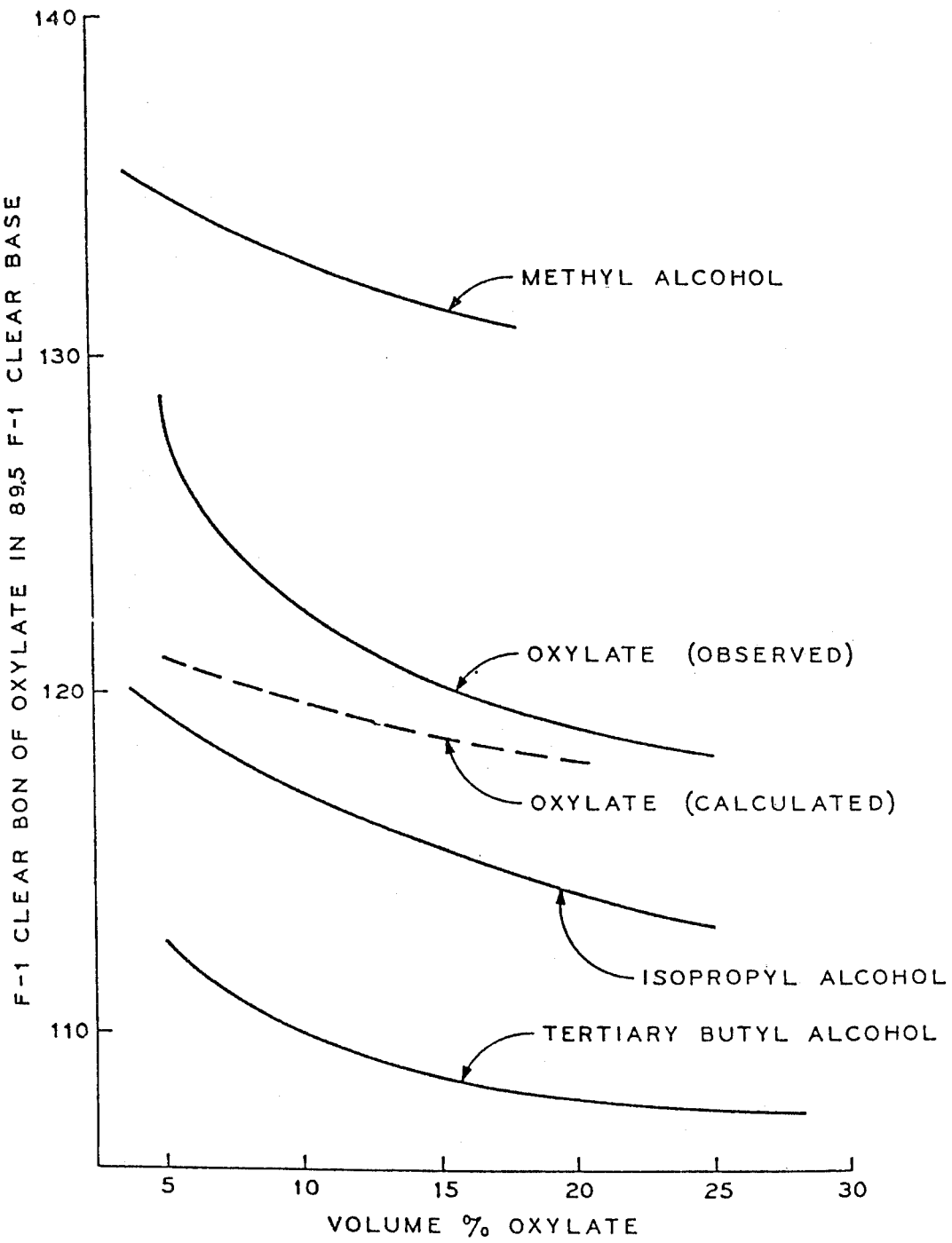
140
130
120
110
F-1 CLEAR BON OF OXYLATE IN 89.5 F-1 CLEAR BASE
METHYL ALCOHOL
OXYLATE (OBSERVED)
OXYLATE (CALCULATED)
ISOPROPYL ALCOHOL
TERTIARY BUTYL ALCOHOL
5
10
15
20
25
30
VOLUME % OXYLATE

MOTOR FUEL COMPOSITION

CROSS REFERENCE TO RELATED APPLICATION

This application is a continuation-in-part of copending application Ser. No. 163,517, filed June 25, 1971 now abandoned the entire disclosure of which is incorporated herein by reference.

BACKGROUND OF THE INVENTION

The present invention relates to a motor fuel composition comprising hydrocarbons and alcohols. The motor fuel is particularly intended for use in automobiles, but can be used in other engines such as boat engines and aircraft engines. The motor fuel composition of the present invention comprises gasoline which, as is well known, is essentially a hydrocarbon mixture having suitable volatility for operating internal combustion engines with spark ignition. The motor fuel composition can contain other additives such as oiliness agents, gum solvents, dyes, gum inhibitors, antioxidants, rust preventatives, and the like. The motor fuel can also contain lead additives. However, one of the advantages of the composition of the present invention is that it provides a relatively high-octane gasoline without the use of lead additives, or with the use of only a relatively small amount (e.g. 1.5 cc alkyl lead additive per gallon of motor fuel) of lead additive.

The use of alcohols in gasoline-boiling-range hydrocarbons has been suggested in a number of patents.

For example, U.S. Pat. Nos. 1,839,362 and 2,596,198 suggest the use of methyl alcohol in gasoline.

U.S. Pat. Nos. 2,662,817 and 2,726,942 disclose the use of methyl alcohol and isopropyl alcohol in gasoline.

U.S. Pat. No. 2,850,368 discloses the use of isopropyl alcohol and secondary butyl alcohol in gasoline. U.S. Pat. No. 2,197,378 discloses the use of isopropyl alcohol and n-butyl alcohol in gasoline.

U.S. Pat. Nos. 2,365,009; 2,404,094 and 2,408,999 all disclose the use of methyl alcohol, isopropyl alcohol, and tertiary butyl alcohol, amongst a wide range of other possible alcohols, for use in gasoline. The latter three patents are directed to major amounts of alcohol containing a minor or small amount of hydrocarbon component; for example, 95 to 90 volume percent alcohol component with only 5 to 10 volume percent hydrocarbon component.

In addition to the above patents concerned primarily with alcohol-gasoline compositions, there are a number of patents directed to other additives for gasoline. For example, U.S. Pat. No. 3,083,087 is directed to use of benzyl esters in gasoline; U.S. Pat. No. 2,874,033 is directed to the use of isopropyl ether plus isopropyl alcohol in gasoline; and U.S. Pat. No. 1,399,227 is directed to the use of acetone in gasoline.

SUMMARY OF THE INVENTION

The motor fuel composition in accordance with the present invention comprises 85–99 volume percent gasoline-boiling-range hydrocarbons and 1 to 15 volume percent oxylate.

The term "oxylate" is used to mean a mixture of tertiary butyl alcohol, isopropyl alcohol, and methyl alcohol. Table I lists composition ranges for the oxylate.

TABLE I

| Component | Broad Range, Volume % | Preferred Range, Volume % | Most Preferred Range, Volume % |
|---|---|---|---|
| t-Butyl alcohol | 2–90 | 20–90 | 40–60 |
| Isopropyl alcohol | 2–50 | 5–40 | 20–30 |
| Methyl alcohol | 2–50 | 5–40 | 20–30 |

The present invention is based upon a number of features. The following features of the present invention can be mentioned.

First, as shown in the drawing, the oxylate gives a synergistic result when blended in low amounts in gasoline, particularly in amounts from about 1 to about 15 percent, and even more so in amounts from 4 to about 15 and 5 to 8 volume percent. For instance, the observed blending octane number for oxylate at about 5 volume percent in gasoline is about 129, whereas the calculated blending octane number based on the respective amounts of the three alcohols is about 121. Although this difference in blending octane number is not extremely large, it can result in a difference in final octane for the motor fuel of about 0.5 octane number greater than would be expected from the calculated oxylate blending octane number. An improvement of 0.5 octane number for gasoline in the 90+ octane range is very important, especially considering the large volume of gasoline which is used. The value of the lead additive which must be added to achieve 0.5 increase in octane number can be over $1 million per year for a major seller of gasoline.

In addition to the synergistic result obtained by adding the oxylate composition to the gasoline in accordance with the present invention, a second feature of the present invention is that the oxylate is of sufficiently high octane number that it can be used to increase the octane number of gasoline in much the same way that lead additives and/or aromatics are used. Thus, oxylate can be used to reduce the concentration of lead additives and/or aromatics in gasoline without sacrificing octane number. Preferably, the motor fuel is essentially free of metallo-organic antiknock agents.

A third particular feature of the present invention which can be mentioned is that the oxylate composition used has a relatively high solubility in gasoline and is not extracted from gasoline easily as is methanol or ethanol.

A fourth feature of the present invention, which is a particularly important feature is that we have devised a particularly advantageous process for manufacturing the oxylate for use in gasoline. Instead of starting with feedstocks such as olefins to obtain alcohols, we start with isobutane feedstock, which is present in many refineries in excess amounts, particularly refineries wherein hydrocracking is carried out to produce gasoline-boiling-range hydrocarbons. In our preferred process the isobutane is oxidized to form tertiary butyl alcohol and acetone plus small amounts of methanol and esters. This process is described in more detail in our applications entitled "GASOLINE PRODUCTION", Ser. No. 163,518, filed June 25, 1971, now abandoned and "PRODUCTION OF GASOLINE", Ser. No. 452,479, filed Mar. 18, 1974, the disclosures of which are incorporated by reference into the present application. The effluent from the oxidation step is hydrogenated to obtain an oxylate mixture comprising t-butyl alcohol, isopropyl alcohol, and methyl alcohol.

Thus, with respect to this fourth feature, it can be said in summary that we have devised and developed a process to make large amounts of oxylates in a refinery at relatively low cost for use in a gasoline composition.

The motor fuel composition in accordance with the present invention can be prepared by blending the oxylate with hydrocarbons boiling between about the boiling point of butane and 450° F. However, it is particularly preferred in the process of the present invention to obtain the motor fuel compositions by blending the oxylate with a relatively light gasoline such as a gasoline boiling between about butane and 230° F. We have found that with light gasoline the oxylate has a relatively higher blending octane number than does the oxylate in wider-boiling gasoline fractions. Particularly for light gasoline produced by HF or $H_2SO_4$ alkylation or by catalytic hydrocracking, we have found that the blending octane number for oxylate is unexpectedly high compared to the blending octane number of oxylate in wider-boiling-range hydrocarbons, for example hydrocarbon fractions containing materials boiling considerably above 230° F.

By use of the terminology "boiling within certain points", we do not mean that the fraction necessarily boils over the entire range, but that it boils within the specified range. Furthermore, it should be understood that for hydrocarbon fractions the initial and end boiling points are not sharp, so that there may be small amounts, such as a few percent, boiling above or below the specified initial and end points.

BRIEF DESCRIPTION OF THE DRAWING

The drawing is a graph illustrating the blending octane number observed for the oxylate in gasoline and, also, as shown by the dotted line, the calculated blending octane number for oxylate in gasoline.

DETAILED DESCRIPTION OF THE DRAWING

To obtain the data plotted in the graph a base gasoline was mixed with each alcohol at levels between 2.5 and 25 volume percent and with an oxylate that consisted of 25 percent methyl alcohol, 25 percent isopropyl alcohol and 50 percent tertiary butyl alcohol. The properties of the base gasoline were: 90 percent boiling point (ASTM D-86), 338° F; RVP, 8.5; olefins, 8 percent; aromatics, 33 percent; saturates, 59 percent; Research octane No., 90. Research octane numbers (RON), F-1 Clear, obtained for the base and for the blends; the blending octane numbers (BON) were computed using the following formula:

$$BON = \frac{O_F-(X_B)(89.5)}{X_A}$$

$O_F$ = RON of Blend
$X_B$ = Vol. Fract. of Base
$X_A$ = Vol. Fract. of Alc.

The calculated BON of oxylate was computed using the following formula:

$$BON = \Sigma (X_i)(BON_i)$$

$X_i$ = Vol. Fract. of alc. $i$
$BON_i$ = BON of alc. $i$ at that fraction

The experimental BON of oxylate was computed using the following formula:

$$BON = \frac{O_F-(X_B)(89.5)}{X_{oxy}}$$

$O_F$ = RON of Blend
$X_B$ = Vol. Fract. of base
$X_{oxy}$ = Vol. Fract. of oxylate Although various embodiments of the invention have been described, it is to be understood that they are meant to be illustrative only and not limiting. Certain features may be changed without departing from the spirit or scope of the present invention. It is apparent that the present invention has broad application to motor fuel compositions containing relatively small amounts of oxylate in gasoline-boiling-range hydrocarbons. Accordingly, the invention is not to be construed as limited to the specific embodiments or examples discussed, but only as defined in the appended claims or substantial equivalents of the claims.

What is claimed is:

1. A lead free motor fuel comprising 85–96 volume percent gasoline-boiling-range hydrocarbons and 4 to 15 volume percent of an oxylate which comprises a mixture of alcohols, said mixture containing about 40–60 volume percent tertiary butyl alcohol, about 20–30 volume percent isopropyl alcohol, and about 20–30 volume percent methyl alcohol.

2. A motor fuel in accordance with claim 1 comprising 92–95 volume percent gasoline-boiling-range hydrocarbons and 5 to 8 volume percent oxylate.

3. A motor fuel in accordance with claim 1 wherein said mixture comprises about 50 volume percent tertiary butyl alcohol, and about 25 volume percent isopropyl alcohol, and about 25 volume percent methyl alcohol.

4. A motor fuel in accordance with claim 1 wherein the gasoline-boiling-range hydrocarbons boil between about n-butane and 450° F.

* * * * *